US007713152B1

(12) United States Patent
Tentler et al.

(10) Patent No.: US 7,713,152 B1
(45) Date of Patent: May 11, 2010

(54) ARROWHEAD WITH UNFOLDING BLADES

(75) Inventors: Lynn A. Tentler, 5303 SW. 25th Pl., Cape Coral, FL (US) 33914; Jeffrey A. Eckert, North Fond du Lac, WI (US); Paul L. Peck, North Fond du Lac, WI (US)

(73) Assignee: Lynn A. Tentler, Cape Coral, FL (US)

( * ) Notice: Subject to any disclaimer, the term of this patent is extended or adjusted under 35 U.S.C. 154(b) by 531 days.

(21) Appl. No.: 11/834,812

(22) Filed: Aug. 7, 2007

Related U.S. Application Data

(60) Provisional application No. 60/877,256, filed on Dec. 26, 2006, provisional application No. 60/950,449, filed on Jul. 18, 2007.

(51) Int. Cl.
*F42B 6/08* (2006.01)

(52) U.S. Cl. ..... 473/583

(58) Field of Classification Search ..... 473/582, 473/583, 584

See application file for complete search history.

(56) References Cited

U.S. PATENT DOCUMENTS

| | | | |
|---|---|---|---|
| 2,671,664 | A | 3/1954 | Zwickey |
| 2,859,970 | A | 11/1958 | Doonan |
| 2,993,697 | A | 7/1961 | Urban |
| 3,000,635 | A | 9/1961 | Nieman |
| 3,014,305 | A | 12/1961 | Yurchich |
| 3,022,077 | A | 2/1962 | Doonan |
| 3,036,395 | A | 5/1962 | Nelson |
| 3,036,396 | A | 5/1962 | Swails |
| 3,064,977 | A | 11/1962 | Zwickey |
| 3,138,383 | A | 6/1964 | McKinzie |
| 3,168,313 | A | 2/1965 | Lint |
| 3,578,328 | A | 5/1971 | Rickey |
| 3,600,835 | A | 8/1971 | Hendricks |
| 3,738,657 | A | 6/1973 | Cox |
| 3,759,519 | A | 9/1973 | Palma |
| 4,099,720 | A | 7/1978 | Zeren |
| 4,166,619 | A | 9/1979 | Bergmann |

(Continued)

OTHER PUBLICATIONS

"Piston Point Broadheads" (advertisement), Piston Point Broadheads, Billings, MT (2007) [US 7,226,375].

*Primary Examiner*—John Ricci
(74) *Attorney, Agent, or Firm*—Craig A. Fieschko, Esq.; DeWitt Ross & Stevens S.C.

(57) ABSTRACT

An arrowhead of the expandable or mechanical broadhead type, i.e., having blades which unfold to increase the effective cutting area of the arrowhead, includes a tip with a rearwardly-extending actuating member which triggers one or more blades into an open state when the tip strikes a target game animal. The blades are pivotable with respect to a body into which the actuating member extends, and they include ears against which the actuating member presses upon tip impact to trigger the blades open. A latching spring maintains the blades in a closed state until the tip and actuating member are driven rearwardly by tip impact, and the tip and actuating member are preferably maintained in a forward and ready-to-trigger state by an opening spring. The actuating member may extend between the blade ears after the blades are triggered open to fix the blades in the open state until the tip is pulled forwardly to withdraw the actuating member from the ears.

115 Claims, 4 Drawing Sheets

U.S. PATENT DOCUMENTS

| | | | | | |
|---|---|---|---|---|---|
| 4,504,063 | A | | 3/1985 | Lebus | |
| 4,529,208 | A | | 7/1985 | Simo | |
| 4,579,348 | A | | 4/1986 | Jones | |
| 4,601,710 | A | | 7/1986 | Moll | |
| 4,615,529 | A | | 10/1986 | Vocal | |
| 4,676,512 | A | | 6/1987 | Simo | |
| 4,729,320 | A | | 3/1988 | Whitten | |
| 4,762,328 | A | | 8/1988 | Beyl | |
| 4,807,382 | A | | 2/1989 | Albrecht | |
| 4,932,671 | A | | 6/1990 | Anderson | |
| 4,940,246 | A | | 7/1990 | Stagg | |
| 4,973,060 | A | * | 11/1990 | Herzing | 473/583 |
| 4,976,443 | A | | 12/1990 | DeLucia | |
| 4,988,112 | A | | 1/1991 | Anderson | |
| 4,998,738 | A | | 3/1991 | Puckett | |
| 5,066,021 | A | | 11/1991 | DeLucia | |
| 5,082,292 | A | | 1/1992 | Puckett | |
| 5,100,143 | A | | 3/1992 | Puckett | |
| 5,102,147 | A | | 4/1992 | Szeluga | |
| 5,112,063 | A | | 5/1992 | Puckett | |
| 5,322,297 | A | * | 6/1994 | Smith | 473/583 |
| 5,564,713 | A | | 10/1996 | Mizek | |
| 5,803,844 | A | | 9/1998 | Anderson | |
| 5,803,845 | A | | 9/1998 | Anderson | |
| 5,836,842 | A | | 11/1998 | McLearan | |
| 5,941,784 | A | | 8/1999 | Mizek | |
| 6,015,357 | A | | 1/2000 | Rizza | |
| 6,174,252 | B1 | | 1/2001 | Mizek | |
| 6,217,467 | B1 | | 4/2001 | Maleski | |
| 6,258,000 | B1 | | 7/2001 | Liechty | |
| 6,270,435 | B1 | | 8/2001 | Sodaro | |
| 6,287,224 | B1 | | 9/2001 | Liechty | |
| 6,398,676 | B1 | | 6/2002 | Mizek | |
| 6,517,454 | B2 | | 2/2003 | Barrie | |
| 6,626,776 | B2 | | 9/2003 | Barrie | |
| 6,758,774 | B2 | | 7/2004 | Liechty | |
| 6,830,523 | B1 | | 12/2004 | Kuhn | |
| 7,226,375 | B1 | | 6/2007 | Sanford | |
| 2007/0161438 | A1 | | 7/2007 | Fulton | |

* cited by examiner 100
108
168
106
110
150
162
132
134
102
104
164
166
126
128
130
152
156
158
148

100
108
168
122
142
106
110
120
146
140
116
150
158
160
170
162
136
132
134
102
104
164
166
144
146
138
154
152
126
128
130
112
118
124
114
156

ARROWHEAD WITH UNFOLDING BLADES

CROSS-REFERENCE TO RELATED APPLICATIONS

This application claims priority under 35 USC §119(e) to U.S. Provisional Patent Application 60/877,256 filed 26 Dec. 2006 and to U.S. Provisional Patent Application 60/950,449 filed 18 Jul. 2007, the entireties of which are incorporated by reference herein.

FIELD OF THE INVENTION

This document concerns an invention relating generally to arrowheads used in archery, and more specifically to broadhead-type arrowheads wherein one or more blades extend outwardly from the body of the arrowhead. Even more specifically, the invention relates to broadhead-type arrowheads wherein one or more blades may unfold from the arrowhead (commonly known as "expandable broadheads" or "mechanical broadheads").

BACKGROUND OF THE INVENTION

When bowhunters hunt game animals, they seek to hit their targets in such a manner that maximum trauma is inflicted upon their first shot (i.e., so that the first shot is a "killing shot"), since there may not be a chance for a second shot. In those cases where the first shot does not immediately critically wound and bring down the animal, it is at least desirable to have the arrow inflict sufficient trauma that heavy bleeding results, thereby resulting in relatively rapid death via loss of blood, as well as a blood trail which the hunter may follow to retrieve the animal. Otherwise, if the animal is only marginally injured, it may undergo prolonged suffering and may lack the ability to fend for itself in the wild—outcomes which most hunters and conservationists frown upon.

In order to maximize trauma, bowhunters often hunt game animals with broadhead-type arrowheads, that is, arrowheads which bear one or more blades extending laterally outwardly from the arrowhead and its trailing arrow shaft. This is in contrast to arrowheads used for recreational archery, which generally have a simple conical/pointed shape with no laterally-extending protrusions. The objective of a broadhead is to increase the effective area of the arrowhead which strikes the target animal, thereby enhancing the size of the inflicted wound and the lethality of the arrow.

However, broadheads suffer from the disadvantage that they are more likely to cause undesirable off-trajectory arrow flight than simple conical arrowheads. Since the blades extending outwardly from the broadhead effectively act as forward fletchings or "wings" on the arrow, even minor misalignments and/or other imperfections in one or more blades can cause an arrow to veer from its intended course. Additionally, the blades also make an arrow more susceptible to being blown off course by wind currents, since the blades can effectively define wind-catching "sails" on the broadhead.

As a result of the flight inaccuracies demonstrated by broadheads, the development of new broadheads has generally followed two paths. A first path involves "fixed-blade" broadheads, wherein the blades are immovably affixed to the arrowhead. These blades are usually designed to extend only a slight distance laterally outwardly from the arrowhead so as to reduce the aerodynamic effect of the blades. A second path involves "expandable" or "mechanical" broadheads, wherein movable blades affixed to the arrowhead are situated in a closed state close to the arrowhead and shaft when launched, but the blades subsequently move outwardly from the arrowhead during flight (preferably late in their flight) or upon striking a target. In the expandable/mechanical broadhead, the blades in their open state may extend further laterally outwardly from the arrowhead than in a fixed-blade broadhead because the blades, being closed for (preferably) most or all of the arrow flight, have lesser effect on arrow trajectory. Stated differently, by reducing the forwardly-facing blade surface area which is exposed during flight of the arrow, and then maximizing this area during or near impact, the expandable/mechanical broadhead seeks to avoid misflight while maximizing lethality.

Despite the foregoing, many prior expandable/mechanical broadheads carry their own unique disadvantages. Several expandable/mechanical broadheads operate by using restraining members (such as rubber O-rings) to hold their blades in place during flight, with the restraining member then being cut or otherwise ejected from the arrowhead at or near impact. The loss of the restraining member then allows the blades to spring open. Such broadheads are inconvenient and/or expensive to use because they require that a hunter obtain and carry a supply of restraining members—which are usually small in size, and easily lost—in order to make continued use of the broadheads in the field. In general, broadheads which do not require any O-rings or other sacrificial members are more conveniently used in the field.

Other expandable/mechanical broadheads require that the blades contact the target animal to open the blades. For example, several broadheads incorporate levers on the frontward/leading sides of the blades whereby the levers, upon contact with the target game, are to urge the blades into their open/unfolded state. Such broadheads can be problematic because some blades may contact the target, animal (and thereby open) before others, which can then cause the arrow to deviate from its intended trajectory. Additionally or alternatively, certain blades may open after entry rather than upon entry, thereby causing the entry wound size to be less than it would be had all blades been open upon entry. Further, some blades may be entirely prevented from opening if they are buried in tissue before their levers or other blade-triggering structures are subjected to sufficient opening force. Many of these broadhead designs also require that the levers or other blade-triggering structures be blunt, since a sharp triggering structure may simply penetrate the animal without encountering sufficient tissue resistance that it triggers the opening of the blade(s). These blunt structures can undesirably slow the arrow to such a degree that even if the blades open and a large entry wound is generated, it will not be sufficiently deep to lethally impair the animal.

More fundamentally, to expand on issues noted above, many expandable/mechanical broadheads suffer from the disadvantage that the blades are triggered to their open/unfolded state at a less than optimal time—either during flight, or after the blades have entered the animal. As previously noted, blades which are open during flight can cause undesirable arrow trajectory variations. As for blades which open after entry, while these may cause significant internal bleeding and other internal damage, the entry wound itself may be of small size, and it may be effectively "plugged" by the arrow shaft. The smaller entry wound (and the arrow stopping the wound) can inhibit blood loss and potentially allow the animal to flee for long distances before it expires.

Another problem experienced by some expandable/mechanical broadheads is the blades may be triggered to open/unfold upon impact and entry with a target animal, but they may then retract to their closed/folded state if the arrow is pulled rearwardly (i.e., the blades open when moving forwardly into a target, but then close when moving in reverse). Such broadheads can be advantageous insofar as they allow easier arrow removal by hunters, but they can be disadvantageous in that the arrows can more easily fall from, or be pulled from, the animal as it flees. An arrow that falls out may allow the animal to more readily bleed out, but it is usually desirable to have the arrow remain in place within the target animal because animals are generally less likely to flee (or to flee as far) when the arrow remains in place.

Another problem with many expandable/mechanical broadheads is their ease of preparation. As previously noted, some require the pre-firing installation of O-rings or other consumables to restrain the blades in a closed state until a time at or near impact, and the need to install such consumables can be inconvenient, particularly where a hunter has limited time to prepare an arrow for firing. Many broadheads also or alternatively require the user to grasp and manipulate the blades to place the broadhead in a firing condition, e.g., the user may need to grasp the blades and fold them into the closed state. These arrangements often result in finger cuts, which in turn cause difficulties with bow operation.

SUMMARY OF THE INVENTION

The invention involves an arrowhead which is intended to at least partially solve the aforementioned problems. To give the reader a basic understanding of some of the advantageous features of the invention, following is a brief summary of preferred versions of the arrowhead, with reference being made to the accompanying drawings to enhance the reader's understanding. Since this is merely a summary, it should be understood that more details regarding the preferred versions may be found in the Detailed Description set forth elsewhere in this document. The claims set forth at the end of this document then define the various versions of the invention in which exclusive rights are secured.

Referring to the exemplary arrowhead depicted in FIGS. 1A-1D at the reference numeral 100, the arrowhead 100 includes a tip 102, a body 104 extending rearwardly from the tip 102 and terminating in a tail end 106 adapted to mount to an arrow shaft (such a shaft not being shown), and one or more blades 108 on the body 104 which each have a pivot end 110 about which the blade 108 pivots with respect to the body 104. Here, the arrowhead 100 is shown with three blades 108, though more or less are possible. Each blade 108 is then pivotable about its pivot end 110 between an open state wherein the blade 108 is folded outwardly from the body 104 (see FIGS. 1C-1D) and a closed state wherein the blade 108 is folded inwardly to rest closer to the body 104 (see FIGS. 1A-1B). As best seen in FIGS. 1B and 1D, an actuating member 112—here provided in the form of a shaft with a protruding nub 114 of lesser diameter, though the actuating member 112 might take other forms—extends rearwardly from the tip 102, and into the interior of the body 104. This actuating member 112 is movable within and along the length of the body 104 such that it may travel rearwardly from the position shown in FIGS. 1A-1B —wherein the tip 102 and actuating member 112 are in an extended in-flight position, prior to impact with a target—to the position shown in FIGS. 1C-1D, wherein the tip 102 (and thus the actuating member 112) is urged rearwardly within the body 104 upon the impact of the tip 102 with a target. As best seen from a comparison of FIGS. 1B and 1D, when the actuating member 112 is urged rearwardly into the interior of the body 104, it urges against the blade pivot ends 110 to move the blades 108 from their closed state (FIG. 1B) to their open state (FIG. 1D), and thus the blades 108 unfold in the moment after the impact of the tip 102 to increase the cutting area of the arrowhead 100.

First and second springs 116 and 118 are seen in FIGS. 1B and 1D, wherein only the cross-section of the second spring 118 is visible. The second spring 118 acts as a latching spring when the arrowhead 100 is in its in-flight closed state (FIGS. 1A-1B), biasing the blades 108 with respect to the body 104 to urge the blades 108 toward the closed state. More particularly, the latching spring 118 acts against a camming surface 120 on the pivot end 110 of each blade 108, wherein the camming surface 120 is contoured to store energy within the second/latching spring 118 when the blade 108 is in the open state, and to relieve energy stored within the second/latching spring 118 when the blade 108 is in the closed state. The latching spring 118 thereby attempts to close the blades 108. In contrast, the first spring 116 constantly biases the actuating member 112 rearwardly with respect to the body 104 to urge the actuating member 112 rearwardly into the interior of the body 104, and therefore against the pivot ends 110 of the blades 108, to urge the blades 108 toward the open state. However, the first spring 116—which may be regarded as a blade opening spring—is defeated by the action of the latching spring 118 until the actuating member 112 begins to move rearwardly owing to impact forces on the tip 102, at which point the opening spring 116 assists the actuating member 112 in defeating the latching spring 118 and opening the blades 108. The opening spring 116 therefore plays only a minor role in opening the blades 108, but it is nonetheless useful in maintaining the actuating member 112 against the pivot ends 110 of the blades 108 when the blades 108 are in their closed state (see FIG. 1B), and preventing the actuating member 112 from sliding forwardly within the body 104 and out of contact with the blade pivot ends 110.

The exemplary arrowhead 100 of FIGS. 1A-1D has the useful feature that once the blades 108 are in the open state (FIGS. 1C-1D), they are fixed in the open state such that forces exerted on the blades 108 cannot pivot the blades 108 back into the closed state (FIGS. 1A-1B), whereby the blades 108 may only pivot into the closed state by movement of the actuating member 112 (e.g., by a user pulling the tip 102 forwardly from the closed state of FIGS. 1A-1B to the open state of FIGS. 1C-1D, so that the latching spring 118 acts to close the blades 108). Stated differently, the blades 108 are only moved from the closed state to the opened state by movement of the actuating member 112 in response to forces acting rearwardly on the tip 102 (e.g., impact forces on the tip 102), and conversely the blades 108 are only moved from the opened state to the closed state by movement of the actuating member 112 in response to forces acting forwardly on the tip 102 (e.g., forward actuation of the tip 102 by the user). Preferably, this is achieved by having the rearward face 122 of the actuating member 112 (and more specifically, its nub 114) bear against the blades 108 (more specifically, against protruding ears 124 on the blade pivot ends 110) when the blades 108 are in the closed state (see FIG. 1B). When the tip 102 and actuating member 112 are moved rearwardly, as in response to tip impact (and with the assistance of the opening spring 116), the actuating member 112 moves rearwardly to more fully rest between the blades 108 (see FIG. 1D), with the nub 114 of the actuating member 112 resting between the blade ears 124 and with the latching spring 118 urging the blades 108 and their ears 124 against the circumference of the actuating member 112 and its nub 114. As a result, the actuating member 112 prevents the blades 108 from rotating to the closed state. When the tip 102 and actuating member 112 are moved forwardly, as by having a user pull the tip 102 forwardly, the nub 114 withdraws from between the blade ears 124 to allow the latching spring 118 to urge the blades 108 into the closed state.

In the foregoing arrangement, the resistances (spring constants) of the opening spring 116 and latching spring 118 are chosen to provide the desired opening force (the force needed on the tip 102 to move the blades 108 from the closed state to the opening state), as well as the desired closing force needed to move the tip 102 and actuating member 112 forwardly to close the blades 108. To some degree, the springs 116 and 118 counteract each others' actions, with the opening spring 116 compressing as the latching spring 118 extends (FIG. 1B), and the latching spring 118 compressing as the opening spring 116 extends (FIG. 1D). Preferably, the springs 116 and 118 are chosen to require between approximately 6 and 48 ounces of force on the tip 102 before the latching spring 118 yields and allows the actuating member 112 to urge the blades 108 into the open state.

The foregoing arrangement is preferably used in conjunction with a preferred tip structure, exemplified in FIGS. 1A-1D. The tip 102 extends rearwardly from a leading edge 126, and includes one or more penetrating surfaces 128 which slope outwardly with respect to the axis of the tip 102 as these penetrating surfaces 128 extend rearwardly. The leading edge 126 and penetrating surfaces 128 are intended to initiate and expand an entry wound as the tip 102 penetrates target game. One or more collecting surfaces 130 are then provided which are forwardly exposed on the tip 102 (i.e., at least a portion of the collecting surfaces 130 is situated such that it will directly impact the tissue of the target game about the entry wound during entry), with these collecting surfaces 130 being oriented at least substantially perpendicular to the axis of the tip 102, and/or being concave with respect to a plane perpendicular to the axis of the tip 102. In FIGS. 1A-1D, these collecting surfaces 130 are provided by concave areas defined between the outer perimeter of a cylindrical tip base 132 and a tetrahedral tip head 134. These collecting surfaces 130 are intended to collect tissue, such that tissue "piles up" behind the collecting surfaces 130 during entry, and so that the collecting surfaces 130 move the tissue forwardly in front of the tip 102 such that an entry wound cannot easily reclose. This effect expands the size of the entry wound, and also helps to generate sufficient rearward force on the actuating member 112 that it almost immediately actuates the blades 108 into their open state upon tip impact (more specifically upon impact of the collecting surfaces 130). The collecting surfaces 130 thereby help to fully open the blades 108 before they enter the target game rather than thereafter, and thereby maximize debilitating trauma.

Another preferred feature of the tip 102 is to make it "finger-safe" so that a user may grasp it and pull it forwardly to move the blades 108 into the closed state without experiencing finger injury. One way to achieve this is to have the tip 102, at its region of greatest circumference (in FIGS. 1A-1D, at the cylindrical tip base 132), lack any edges which are sufficiently sharp to cut a user's finger when grasped by a user. Such an arrangement may be achieved by having a large continuous graspable surface oriented at least substantially parallel to the axis extending through the tip 102 and body 104. For example, if the tip 102 is regarded as a set of continuous surfaces (e.g., the "facets" of the tip base 132 and head 134) bounded by edges, at least one of the continuous surfaces should extend both rearwardly and circumferentially, be aligned at least substantially parallel to the axis extending through the tip 102, and should have an area which is preferably greater than or equal to at least one-third of the largest continuous surface included on the tip 102. In the tip 102 of FIGS. 1A-1D, these conditions are satisfied by the outer perimeter of the tip base 132.

Further advantages, features, purposes, and uses of the invention will be apparent from the remainder of this document in conjunction with the associated drawings.

DETAILED DESCRIPTION OF PREFERRED VERSIONS OF THE INVENTION

Figure 1A:
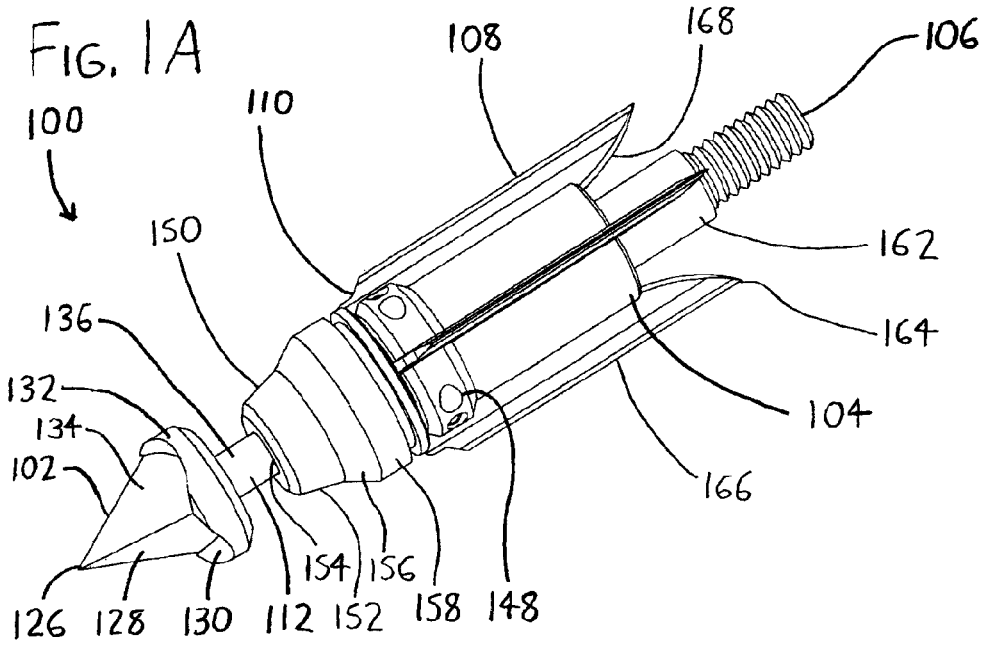
FIG. 1A is a perspective view of a first preferred version of an arrowhead 100 which exemplifies concepts of the invention, with the arrowhead 100 having a leading tip 102 having an actuating member 112 extending rearwardly into an arrowhead body 104, with the body bearing three blades 108 spaced at equal angles about the axis of the arrowhead 100 (one blade 108 having an edge visible in the foreground, and the other two blades being partially shown in the background). Here the blades 108 are depicted in a closed state wherein they may pivot to an open state (seen in FIG. 1C) when the arrowhead tip 102 impacts a target and is driven rearwardly (along with the actuating member 112) toward the body 104.

To review the arrowhead 100 of FIGS. 1A-1D in greater detail, the tip 102 is preferably made removable from the actuating member 112, as by threading or force-fitting the forward end of the actuating member 112 into a bore (not shown) defined within the tip base 132 along its central axis. This allows the tip 102 to be removed and replaced with other tips if desired, e.g., the tip 202 of FIGS. 2A-2B (discussed below), a conventional conical tip, or other tips. Depending on the configuration and weight (and thus the inertia) of the chosen tip, as well as the force of the bow used to launch the arrow, the springs 116 and 118 may need to be chosen to require greater rearward force on the tip before the blades 108 open. Otherwise, the inertia of the tip may cause inadvertent blade opening when the arrow is launched and the shaft of the arrow is thrust forwardly, with the inertia of the tip effectively generating a rearward force on the tip with respect to the body 104.

Figure 1B:
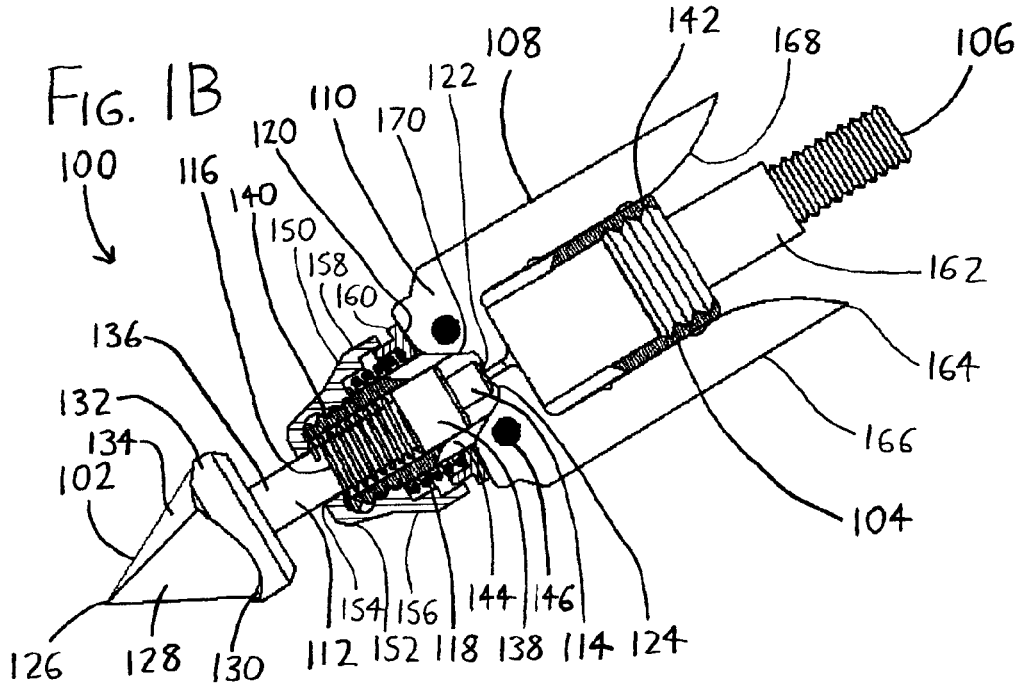
FIG. 1B depicts a partial cross-sectional view of the arrowhead 100 of FIG. 1A, wherein the body 104 (and more specifically its forward body end 140 and rearward body end 142), as well as its associated spring housing 150, latching spring 118, and latching member 160, are all shown sectioned along planes aligned with two of the blades 108. Here the opening spring 116 urges the actuating member 112 against blade ears 124 situated at the blade pivot ends 110 (with the blades 108 being rotatable about pivots 146) in an attempt to pivot the blades 108 into the open state. However, the latching spring 118 urges the blades 108 into the closed state at camming surfaces 120, defeating the efforts of the opening spring 116.
Figure 1C:
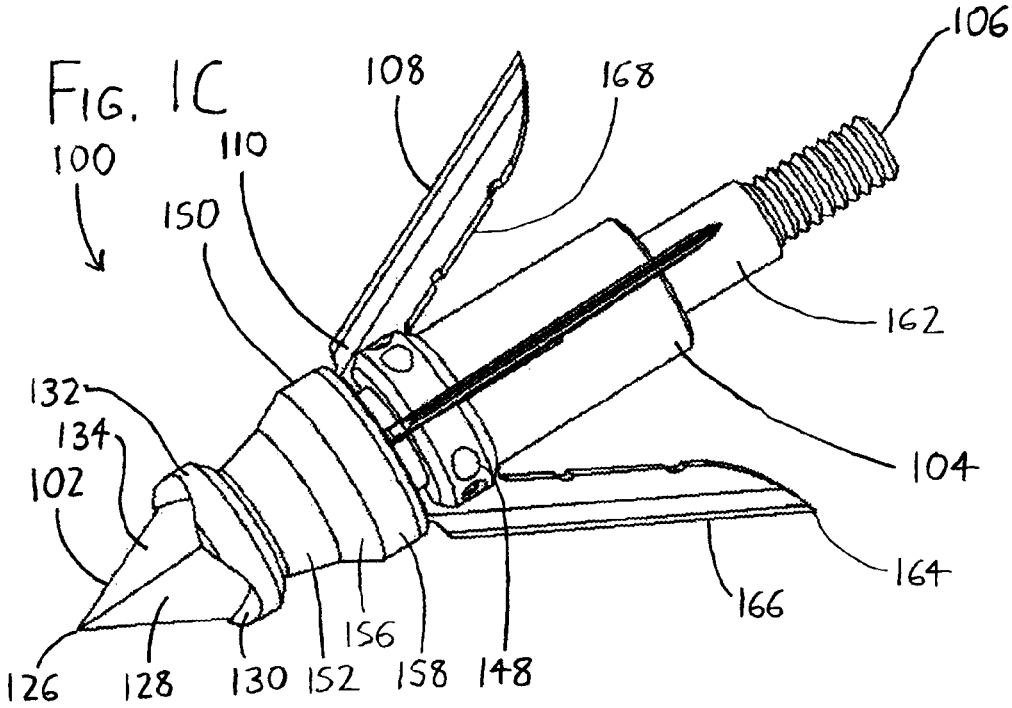
FIG. 1C is a perspective view of the arrowhead 100 of FIGS. 1A and 1B wherein the arrowhead tip 102 has been driven rearwardly to urge the actuating member 112 into the body 104, thereby defeating the latching spring 118 of FIG. 1B and urging the blades 108 into an open state.
Figure 1D:
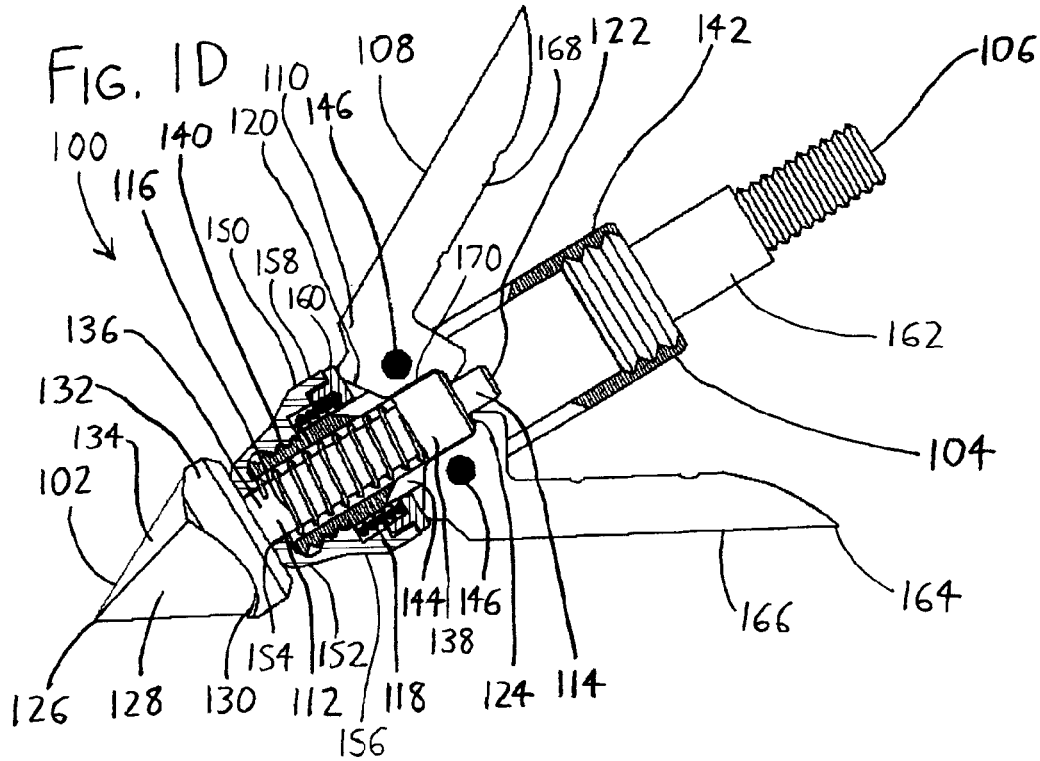
FIG. 1D is a partial cross-sectional view similar to that of FIG. 1B, but wherein the arrowhead 100 is shown with its blades 108 in the open state, as in FIG. 1C.

Referring particularly to FIGS. 1B and 1D, the actuating member 112, which is removably or permanently affixed to the tip 102, is preferably defined by a cylindrical intermediate shaft 136 extending rearwardly from the tip 102, a cylindrical larger diameter land 138 extending rearwardly from the cylindrical intermediate shaft 136, and the (cylindrical) smaller diameter nub 114 extending rearwardly from the land 138 (with all of the shaft 136, land 138, and nub 114 being coaxially situated along the axis extending rearwardly through the tip 102 and body 104). The opening spring 116 may then be fit about the shaft 136 to bear against the land 138 to thereby urge the land 138, and thus the actuating member 112 and tip 102, rearwardly to prevent the actuating member 112 and the tip 102 from freely sliding forwardly within the body 104 (and also to provide some assistance in the opening of the blades 108). If the opening spring 116 was omitted, the actuating member 112 and tip 102 could freely slide forwardly within the body 104 and "rattle" therein, which can be annoying (particularly when the arrow is being nocked and aimed). To ease in the installation of the opening spring 116, it is useful to make the land 138 removably affixable to the shaft 136, e.g., by threading the rearward end of the shaft 136 into an axial bore (not shown) in the land 138.

Referring also particularly to FIGS. 1B and 1D, the body 104 is then defined as a generally cylindrical member having a forward body end 140, a rearward body end 142, and blade slots 144 extending along the length of the body 104. The blades 108 are then preferably pivotally mounted within the blade slots 144 at pivots 146, e.g., threaded or unthreaded pins or other cylindrical members extending through or from the blades 108 and into the body 104 at opposing longitudinal sides of the blade slots 144. Pin apertures 148 for receiving such pins are visible in FIGS. 1A and 1C, wherein a pin may be inserted in one of the apertures 148 to extend into the body 104, then into a blade slot 144 and through a blade 108 therein, and then back into the body 104 within the pin aperture 148 at the opposite side of the blade slot 144. The forward body end 140 closely receives the land 138 of the actuating member 112 therein, such that the land 138 (and thus the actuating member 112) is retrained to slidably translate forwardly and rearwardly within the body 104.

The forward body end 140 also preferably bears external threading whereby a spring housing 150 may be threaded onto the forward end 140. The spring housing 150 has a forward spring housing end 152 with a shaft aperture 154 sized to closely and translatably receive the intermediate shaft 136 therein, an intermediate spring housing portion 156 which is internally threaded to allow the forward body end 140 to be threaded thereon, and a rearward spring housing portion 158 with internal steps configured to receive the latching spring 118 and a latching member 160. This latching member 160, shown in the form of a thrust washer having a T-shaped section, is urged by the latching spring 118 against the camming surfaces 120 of the pivot ends 110 of the blades 108.

The foregoing components can be assembled into the arrangement of FIGS. 1A-1D by extending the intermediate shaft 136 of the actuating member 112 within the shaft aperture 154 of the spring housing 150; fitting the opening spring 116 about the intermediate shaft 136, and against the forward spring housing end 152; threading or otherwise fitting the land 138 (and nub 114) on the rearward end of the intermediate shaft 136, such that the opening spring 116 is situated between the forward spring housing end 152 and the land 138; fitting a forward end of the latching spring 118 within the rearward spring housing portion 158 about the actuating member 112, and fitting the latching member 160 about the rearward end of the latching spring 118 (and also within the rearward spring housing portion 158); and then threading or otherwise fitting the spring housing 150 on the forward body end 140 so that the nub 114 of the actuating member 112 bears against the ears 124 of the (closed) blades 108, and so that the latching member 160 is urged by the latching spring 118 onto the camming surfaces 120 of the (closed) blades 108.

The rearward body end 142 is then preferably internally threaded or otherwise configured to receive a shaft mount 162, which extends rearwardly to a threaded tail end 106 adapted to be threaded (or otherwise affixed) within an arrow shaft (not shown). Referring particularly to FIGS. 1B and 1D, a section of the interior of the body 104 situated forwardly of the shaft mount 162, and rearwardly of the pivot ends 110 of the blades 108, is preferably left empty so that a user may insert/install packing weights within the rearward body end 142 if adaptation of the mass of the arrowhead 100 is desired.

The blades 108 extend from their pivot ends 110 to outer blade tips 164, with an outer sharpened blade cutting length 166 and an inner (optionally sharpened) blade edge 168 folding closely adjacent to (or within) the rearward body end 142. The pivot ends 110 of the blades 108 have abutment surfaces 170 (see FIGS. 1B and 1D) which extend inwardly toward the interior of the body 104 from the camming surfaces 120. Owing to the placement of the ears 124 rearwardly of the pivots 146, the space between the blades' abutment surfaces 170 defines a pocket which expands to receive the actuating member 112 when the blades 108 move to the open state, with the abutment surfaces 170 receiving the land 138 of the actuating member 112 therebetween when the actuating member 112 is driven rearwardly by tip impact (see FIG. 1D). In similar respects, the ears 124 move from the rearward face 122 of the nub 114 to receive the outer circumference of the nub 114 therebetween when the actuating member 112 is driven rearwardly and the blades 108 move to the open state. So long as the ears 124 are urged by the latching spring 118 against the rearward face 122 of the nub 114, the latching spring 118 assists in maintaining the actuating member 112 and tip 102 in their forwardly-extended position (as shown in FIGS. 1A-1B). Otherwise, once the tip 102 and actuating member 112 are urged rearwardly to situate the nub 114 between the ears 124 (and also situate the land 138 between the abutment surfaces 170), the blades 108 will be effectively "locked" into the open state against the closing action of the latching spring 118, such that the blades 108 will only pivot back into the closed state once the actuating member 112 is pulled forwardly (as by the user pulling the tip 102 forwardly). The camming surfaces 120 are configured such that when the blades 108 pivot from their closed states (FIGS. 1A-1B) to their open states (FIGS. 1C-1D), the latching member 160—which is biased against the camming surfaces 120 by the latching spring 118, and which is configured to translate forwardly and rearwardly within the rearward spring housing portion 158—rides outwardly along the camming surfaces 120. At the same time, the camming surfaces 120 approach the spring housing 150 and push the latching member 160 forwardly to compress the latching spring 118.

Because the actuating member 112 (and its associated intermediate shaft 136, land 138, and nub 114) are cylindrical, it (and the attached tip 102) may be rotated by a user about the axis of the arrowhead 100 into any desired orientation, which may be useful if a user believes that certain features of the tip 102 (e.g., the edges of the penetrating surfaces 128 of the tip head 134) are preferentially aligned with the blades 108, and/or with arrow fletchings, for better aerodynamic performance. It is noted that the angular orientation of the tip 102 depicted in FIGS. 1A-1D is not believed to have any significant impact on flight. However, if the tip 102 was replaced with an alternative tip—e.g., one with fixed extending blades, and/or one which is configured to impart rotation to the tip upon launching the arrow—the ability to align the tip into some desired angular orientation (or the ability for the tip to freely rotate about the axis of the arrowhead 100 into an orientation of least resistance) may be useful. If rotation of the tip 102 with respect to the body 104 is regarded as being undesirable, this could be avoided, for example, by forming the actuating member 112 with a non-cylindrical cross-section (and similarly forming the interior of the body 104 with a complementarity-shaped cross section wherein the actuating member 112 may translate), so that the actuating member 112 (and its affixed tip 102) cannot rotate with respect to the body 104.

In some cases, it may be desirable to disable the ability of the blades 108 to transition from the closed to the open state (for example, when target shooting). In this case, referring to FIGS. 1A and 1B, a disabler (not shown)—e.g., a split ring which is preferably made of rubber or some other flexible material—can be fit onto the intermediate shaft 136 of the actuating member 112 between the tip base 132 and the body 104. The disabler can prevent rearward motion of the tip 102 and actuating member 112 to such an extent that actuation of the blades 108 to the open state is prevented. Alternatively, if a user wishes to shoot an arrow with the blades 108 of the arrowhead 100 in the open state, the user only needs to push the tip 102 rearwardly to move the blades 108 to the open state (and lock them into this state), and the arrow may be launched thereafter.

In testing, the arrowhead 100 has been found to work exceedingly well. Since the springs 116 and 118 can be configured to dependably open the blades 108 only at the end of flight—i.e., immediately after the tip 102 strikes the target, with the blades 108 fully deploying to the open state before entering the target—the wound induced by the arrowhead 100 is exceedingly large, with exceedingly deep penetration by the arrowhead 100. Wound size and penetration is believed to be enhanced by the aforementioned preferred configuration for the tip 102.

Figure 2A:
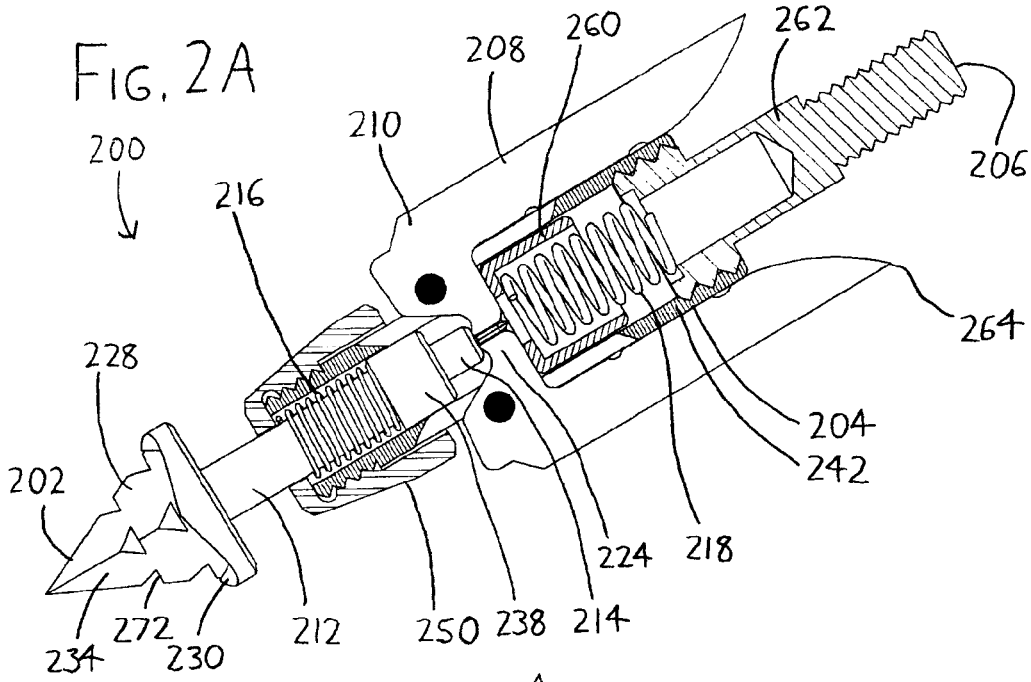
FIG. 2A is a partial cross-sectional view of a second preferred version of an arrowhead 200 which also exemplifies concepts of the invention, wherein its blades 208 are shown in a closed state (similarly to the arrowhead 100 of FIG. 1B). Here the latching spring 218 is situated within the rearward body end 242, unlike the arrowhead 100 of FIG. 1B, wherein the latching spring 118 is situated within the forward body end 140.
Figure 2B:
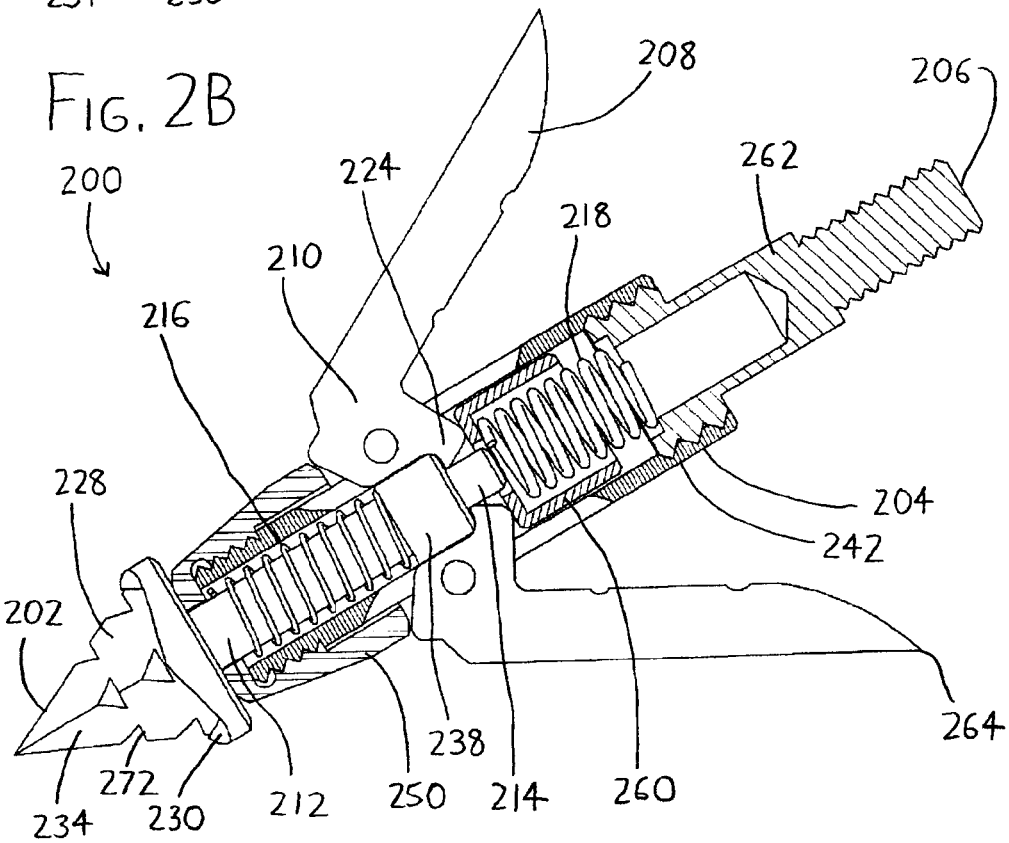
FIG. 2B is a partial cross-sectional view of the arrowhead 200 of FIG. 2A, wherein the actuating member 212 has been driven rearwardly from impact of the tip 202 with a target, thereby defeating the latching spring 218 and urging the blades 208 into an open state.

Arrowheads conforming to the concepts of the invention need not take the form of the arrowhead 100, and a wide variety of other configurations is possible. One example is shown in FIGS. 2A-2B, which includes, as in the arrowhead 100, a tip 202 with a rearwardly extending actuating member 212, and a body 204 into which the actuating member 212 extends to actuate one or more blades 208 into an open state (FIG. 2B) from a closed state (FIG. 2A) when the tip 202 and actuating member 212 are driven rearwardly. However, the arrowhead 200 has several notable differences from the arrowhead 100.

First, whereas the opening spring 116 of the arrowhead 100 is at least partially situated within the latching spring 118, with both the opening spring 116 and latching spring 118 resting within the forward body end 140, the arrowhead 200 situates the latching spring 218 within the rearward body end 242, between the shaft mount 262 and a latching member 260 engaging the blade ears 224. As in the arrowhead 100, the opening spring 216 and latching spring 218 are still coaxially aligned along the axis of the arrowhead 200. Note that since the opening spring 216 is not fit within the latching spring 218, the body 204 and spring housing 250 might be formed with a smaller diameter than the corresponding body 104 and spring housing 150 of the arrowhead 100. The central aperture of the latching member 260 does not encircle the opening spring 216 as does the latching member 160 of the arrowhead 100, and instead it receives the nub 214 of the actuating member 212 when the blades 208 are in the open state.

Second, the tip 202 has penetrating surfaces 228 and collecting surfaces 230 as in the arrowhead 100, but additional collecting surfaces 272 are defined within the collecting surfaces 230 (with the collecting surfaces 272 being defined at the rearward sides of notches defined at the corners of the tetrahedral tip head 234).

Figure 3A:
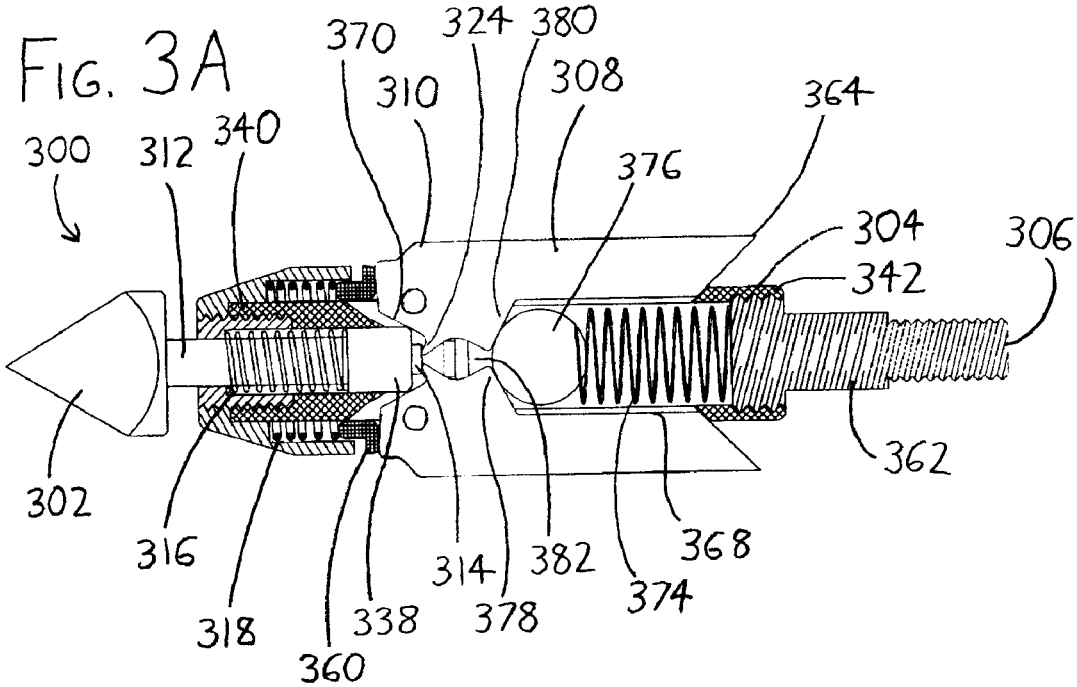
FIG. 3A is a partial cross-sectional view of a third preferred version of an arrowhead 300 which also exemplifies concepts of the invention, wherein its blades 308 are shown in a closed state (similarly to the arrowhead 100 of FIG. 1B and the arrowhead 200 of FIG. 2A). Here an actuating member 312 may be urged rearwardly by impact forces on a tip 302 (and also by the force of an opening spring 316) to defeat a latching spring 318 holding the blades 308 in a closed state, and thereby move the blades 308 to an open state. At the same time, a second opening spring 374 assists in camming the blades 308 open via the action of a second actuating member 376 on second camming surfaces 380.
Figure 3B:
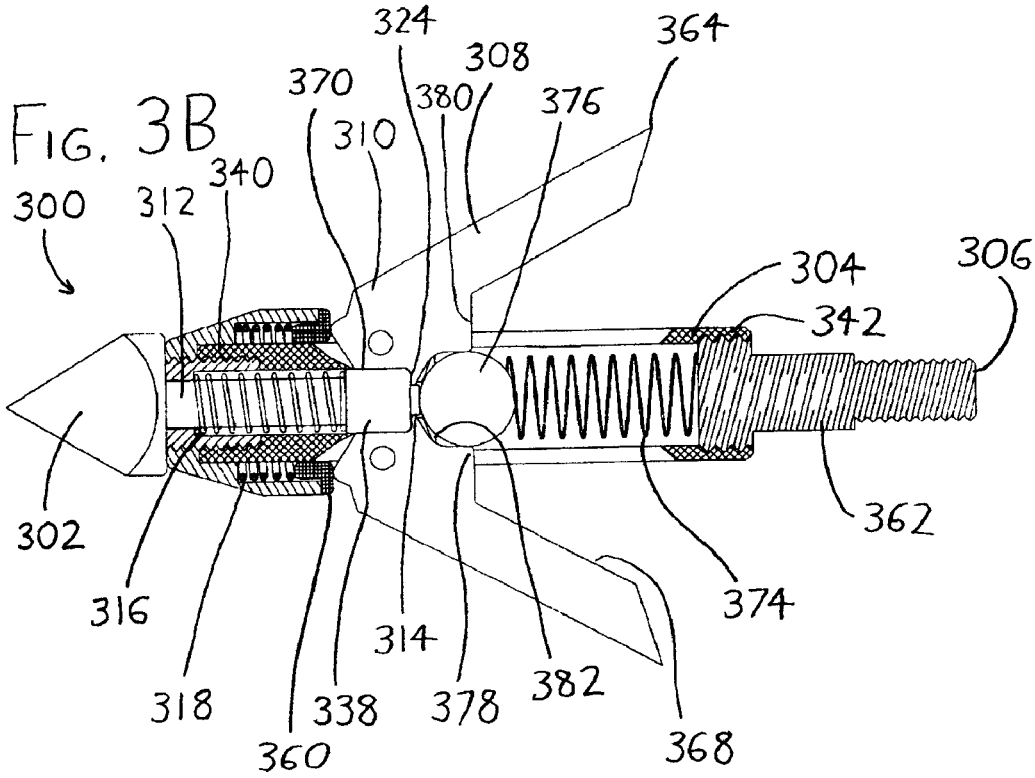
FIG. 3B is a partial cross-sectional view of the arrowhead 300 of FIG. 3A, wherein the blades 308 are shown in their open state.

Another version of the invention, shown in FIGS. 3A-3B, involves an arrowhead 300 which is similar in certain respects to the arrowheads 100 and 200. Here, the arrowhead 300 includes an actuating member 312, opening spring 316, and latching spring 318 within the forward body end 340, and these act similarly to the corresponding components in the arrowhead 100. However, a second opening spring 374 is provided within the rearward body end 342 (similar to the latching spring 218 of the arrowhead 200), and it urges a second actuating member 376—here simply provided in the form of a sphere—toward second ears 378 on the blades 308, with the second ears 378 being located rearwardly of the first ears 324). Second camming surfaces 380 also extend between the second ears 378 and the inner blade edge 368, and these second camming surfaces 380 are angled (see FIG. 3A) such that the spherical second actuating member 376, as driven by the second opening spring 374, will tend to attempt to urge the blades 308 into their open state (with the actuating member 312 and opening spring 316 simultaneously attempting to urge the blades 308 into their open state via the (first) ears 324. As with the arrowheads 100 and 200, the latching spring 318 is chosen with a spring force such that the first and second opening springs 316 and 374 are defeated (and blade opening is deterred) until tip impact occurs and the actuating member 312 is driven rearwardly. When this happens, the actuating member 312 urges the blades 308 open via their (first) ears 324, and the nub 314 and land 338 of the actuating member 312 move between the ears 324 and abutment surfaces 370 of the blades 308, to lock the blades 308 in the open state (as in the arrowhead 100). At the same time, the second actuating member 376—which is urged forwardly by the second opening spring 374, and also by its forward momentum upon target impact—assists in urging the blades 308 toward the open state, and it will move between the second camming surfaces 380 to continue forwardly past the second ears 378, and into a pocket 382 defined between the first and second ears 324 and 378, to also help lock the blades 308 in the open state. Note that here, the second ears 378 move in the opposite direction from the second actuating member 376—with the second ears 378 moving rearwardly as the second actuating member 376 moves forwardly—whereas the first ears 324 move in the same direction (rearwardly) as the first actuating member 312. The arrowhead 300 thus includes two means of urging the blades 308 toward the open state, and locking them into this state. This arrangement can be useful to further ensure near-instantaneous deployment of the blades 308 into the open state when the tip 302 impacts the target: even if the force of tip entry fails to immediately drive the actuating member 312 sufficiently far rearwardly to open the blades 308, the second actuating member 376 may assist in opening the blades 308 so that they are fully opened before entering the target, thereby maximizing trauma. Note that the arrangement of the arrowhead 300 can be particularly useful where tips 302 are used which may not immediately generate appreciable rearward impact forces, e.g., where an elongated conical tip or other tip without collecting surfaces is used. Also note that depending on the configuration of the second ears 378 and pocket 382, the second actuating member 376 may continue to lock the blades 308 in the open state even if the tip 302 is pulled forwardly (an action which, in the arrowheads 100 and 200, would be sufficient to unlock the blades and move them to the closed state). Thus, it can be useful to slope the walls of the pocket 382 such that when the tip 302 and actuating member 312 are pulled forwardly, the walls of the pocket 382 will cam the second actuating member 376 rearwardly out of the pocket 382 via the force of the latching spring 318.

Yet another version of the invention, one not shown in the drawings, involves an arrowhead similar to that of FIGS. 3A-3B, but wherein the second opening spring 374 is omitted and momentum alone is used to drive the second actuating member 376 forwardly to assist with opening and locking of the blades 308. In this case, omission of the second opening spring 374, and use of a spherical second actuating member 376, might allow the second actuating member 376 to freely roll and "rattle" within the rearward body end 342 as the user lifts and nocks the arrow (which is annoying and undesirable). Thus, in this case it is useful to extend the sloped second camming surfaces 380 along at least a substantial portion of the inner blade edge 368, such that the second camming surfaces 380 and inner blade edges 368 restrain the second actuating member 376 at the rear of the rearward body end 342 and against the shaft mount 362 when the blades 308 are in the closed state. In other words, when the blades 308 are in the closed state, the second actuating member 376 is held between the second camming surfaces 380/inner blade edges 368, and is also held against the shaft mount 362 by the second camming surfaces 380/inner blade edges 368).

It is emphasized that the invention encompasses a wide variety of other arrowheads other than those discussed above. As previously noted, the invention may utilize tips 102/202/302 with configurations other than those shown and described. This includes tips 102/202/302 with other than tetrahedral heads 134, and/or cylindrical bases 132, with or without collecting surfaces 130/272, and with or without blades (these blades being distinct from those blades 108/208/308 on the arrowhead body 104/204/304).

As another example, the invention may use fewer or more blades 108/208/308, and the blades 108/208/308 may have configurations other than those shown and described. For example, apart from having different blade lengths, widths, and/or thicknesses, blades 108/208/308 could be configured to be curved, notched/barbed, or could incorporate other design variations. Further, blades 108/208/308 (and their blade slots 144) need not be thin/planar, and blades 108/208/308 can take the form of any members which bear sharp edges and/or tips. Different blades 108/208/308 on the same arrowhead 100/200/300 could have different characteristics, and fixed blades might be installed on an arrowhead 100/200/300 as well as pivotable blades 108/208/308. Additionally, while the preferred versions of the arrowheads 100/200/300 discussed above have the blades 108/208/308 pivot outwardly toward the tips 102/202/302, blades 108/208/308 could instead or additionally unfold away from the tip 102/202/302, rather than toward it (i.e., the pivots may be situated rearwardly on the arrowhead 100/200/300, with the outer blade tips 164/264/364 being situated forwardly). Further, while this document describes blades 108/208/308 pivoting about "pivot ends" 110/210/310, it should be understood that a pivot end 110/210/310 need not necessarily be directly on or adjacent to a terminal boundary of a blade 108/208/308, i.e., a pivot end 110/210/310 can be located on an intermediate portion of the length of the blade 108/208/308 such that the blade 108/208/308 extends from opposing sides of the pivot end 110/210/310 for some distance along the length of the blade 108/208/308.

The configuration of the body 104/204/304 of an arrowhead 100/200/300 may also be altered. As examples, apart from varying the length and/or internal/external diameters of the body 104/204/304, the body 104/204/304 may have a polygonal cross-section (and the blade slots 144 may then be situated on the sides or the corners of the polygon), or another differently-shaped cross-section; the blade slots 144 (and thus the blades 108/208/308) may be at angles with respect to the axis of the arrowhead 100/200/300, rather than being parallel to it; the blades 108/208/308 need not be symmetrically spaced about the perimeter of the body 104/204/304; and so on.

The various mechanisms used to effect the opening and closing of the blades 108/208/308 may also be varied. As one example, the opening spring 116/216/316 and/or latching spring 118/218/318 need not take the form of conventional helical/coil springs, and could take the form of other springs, e.g., elastomeric springs (as by forming a spring of an elastic tube or ring, an elastic plug, a rubber band, or the like); pneumatic springs (as by forming the actuating member as a piston biased by a compressible/expandable pocket of air, and/or by forming a latching spring as a toroidal or other compressible bladder), or other springs (e.g., leaf springs, cantilever springs, Belleville springs, etc.). As illustrated by a comparison of the arrowhead 300 with the arrowheads 100 and 200, it is possible for additional springs to be incorporated, or for their roles to be changed. As an example, consider that the second opening spring 374 and second actuating member 376 of the arrowhead 300 could be reconfigured into a second latching spring and second latching member by having them take the form of the latching spring 218 and latching member 260 of the arrowhead 200. It is notable that an opening spring 116/216/316 is not required, particularly where the actuating member 112/212/312 (more specifically its land 138/238/338 and/or nub 114/214/314) lock the blades 108/208/308 in the open state once the open state is achieved. As noted previously, the opening spring 116/216/316 is nonetheless useful to prevent the actuating member 112/212/312 and tip 102/202/302 from freely sliding and "rattling" within the body 104/204/304. However, if the configuration of the actuating member 112/212/312 is changed—e.g., if the cylindrical nub 114/214/314 was replaced with a conical nub, such that the nub does not lock the blades 108/208/308 into their open state—the opening spring 116/216/316 is of greater use to help maintain the blades 108/208/308 in their open state upon and after tip impact. (The same is true if the configuration of the blades 108/208/308 is altered in certain respects, e.g., by moving the blade ears 124/224/324 forwardly of the pivot, and altering the configuration of the actuating member nub 114/214/314 and land 138/238/338, such that the interaction of the blade pivot ends 110/210/310 and actuating member 112/212/312 does not lock the blades 108/208/308 in the open state.) The actuating member 112/212/312 may also be provided with configurations vastly different from the cylindrical shaft-like shape shown in the drawings. As examples, it may have a cross-section which is polygonal rather than circular, or might even have a more complex cross-section (e.g., it might incorporate a hollow interior and/or a side slot wherein a spring or pin might be fit); it need not have a nub 114/214/314 or other variations in its cross-section (or alternatively it could include numerous variations in its cross-section along its length); it could be formed of an articulated linkage or other interconnected parts; and so forth.

All other components of an arrowhead 100/200/300 can similarly undergo a variety of changes in configuration. For example, the latching member 160/260/360 can assume the form of a thrust washer having a T-shaped section (as in the arrowhead 100) or an L-shaped cross-section (as in the arrowheads 200 and 300), or it need not take the form of a thrust washer at all. To illustrate, the latching member 260 of FIGS. 2A-2B could take the form of a cylindrical plug which is driven by the latching spring 218 onto the blade ears 224. As another example, the shaft mount need not take the form of the illustrated shaft mounts 162, 262, and 362, and it might bear an internal front bore into which the rearward body ends 142, 242, and 342 are received, and/or it might bear an internal rear bore (rather than a threaded tail end 106/206/306) for receiving an arrow shaft therein, rather than being received within an arrow shaft. Other modes of attaching an arrowhead 100/200/300 to an arrow are also possible, e.g., the shaft mount 162/262/362 might be entirely eliminated, and the arrow shaft might be directly received within the rearward body end 142/242/342.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. An arrowhead including:

a. a tip;

b. a body extending rearwardly from the tip, wherein the arrowhead has a length extending along an axis extending rearwardly through the tip and body;

c. at least one blade having:

(1) a pivot end pivotally mounted to a pivot on the body, and (2) a cutting length adjacent the pivot, the blade being pivotable between:

i. an open state wherein the cutting length of the blade is folded outwardly from the body, and ii. a closed state wherein the cutting length of the blade is folded inwardly to rest closer to the body, d. an actuating member movable along the length of the arrowhead, wherein:

(1) movement of the actuating member pivots the blade between the open and closed states, (2) the blade, once in the open state, is fixed in the open state such that forces exerted on the cutting length of the blade cannot pivot the blade into the closed state, whereby the blade may only pivot into the closed state by movement of the actuating member.

2. The arrowhead of claim 1 wherein the actuating member is actuated to move in response to forces acting rearwardly and forwardly on the tip.

3. The arrowhead of claim 2 wherein the blade may only pivot into the closed state by movement of the actuating member in response to forces acting forwardly on the tip.

4. The arrowhead of claim 1 wherein the actuating member acts on the pivot end of the blade to pivot the blade into the open state.

5. The arrowhead of claim 4 wherein:

a. the pivot end of the blade includes an actuating ear extending therefrom;

b. the actuating member includes a protruding nub wherein:

(1) when the blade is in the closed state, a face of the nub acts on the actuating ear to pivot the blade toward the open state, and (2) when the blade is in the open state, the face of the nub rests off of and adjacent to the actuating ear.

6. The arrowhead of claim 4 wherein the actuating member is urged against the pivot end of the blade by an opening spring.

7. The arrowhead of claim 1 wherein:

a. the arrowhead includes two or more of the blades; and b. when the blades are in the:

(1) open state, the actuating member rests between the blades, with the blades being urged against the actuating member's circumference;

(2) closed state, the blades are urged against a surface on the actuating member situated off of the actuating member's circumference.

8. The arrowhead of claim 7 wherein:

a. the pivot end of each blade includes an actuating ear extending therefrom;

b. the actuating member includes a protruding nub wherein:

(1) when the blades are in the open state, the nub rests between the actuating ears of the blades, with the actuating ears being urged against the nub's circumference;

(2) when the blades are in the closed state, the nub does not rest between the actuating ears of the blades.

9. The arrowhead of claim 1 wherein:

a. the tip is movable along the length of the arrowhead, and b. the actuating member is fixed with respect to the tip.

10. The arrowhead of claim 9 wherein the actuating member is urged against the pivot end of the blade by an opening spring.

11. The arrowhead of claim 9 wherein the actuating member is urged rearwardly by an opening spring situated between the body and the actuating member.

12. The arrowhead of claim 1 further including a latching spring urging the blade toward the closed state.

13. The arrowhead of claim 12 wherein the latching spring acts on the pivot end of the blade to pivot the blade toward the closed state.

14. The arrowhead of claim 13 wherein the pivot end of the blade includes a camming surface thereon upon which the latching spring acts, the camming surface being contoured to:

a. store energy within the latching spring when the blade is in the open state, and b. relieve energy stored within the latching spring when the blade is in the closed state.

15. The arrowhead of claim 1 further including:

a. an opening spring urging the actuating member against the pivot end of the blade to urge the blade toward the open state, and b. a latching spring urging the blade toward the closed state.

16. The arrowhead of claim 15 wherein the opening spring and latching spring:

a. are coaxial with, and b. spaced along, the axis of the body.

17. The arrowhead of claim 15 wherein the opening spring is at least partially situated within the latching spring.

18. The arrowhead of claim 15 wherein:

a. the opening spring compresses as the latching spring extends, and b. the latching spring compresses as the opening spring extends.

19. The arrowhead of claim 1 wherein the tip:

a. extends rearwardly from a leading edge, and b. includes:

(1) one or more penetrating surfaces sloping outwardly with respect to the axis of the tip as these penetrating surfaces extend rearwardly;

(2) one or more collecting surfaces which are forwardly exposed on the tip, the collecting surfaces being oriented:

i. at least substantially perpendicular to the axis of the tip, and/or ii. concave with respect to a plane perpendicular to the axis of the tip.

20. The arrowhead of claim 1 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

21. The arrowhead of claim 1 wherein the tip, at its region of greatest circumference, lacks any edges which are sufficiently sharp to cut a user's finger when grasped by a user.

22. An arrowhead including:

a. a tip;

b. a body extending rearwardly from the tip, the body including:

(1) at least one blade having a pivot end pivotally mounted to a pivot on the body, the blade being pivotable between:

i. an open state wherein the blade is folded outwardly from the body, and ii. a closed state wherein the blade is folded inwardly to rest closer to the body, (2) an actuating member translatably movable with respect to the body, the actuating member being constantly biased to engage the pivot end and urge the blade toward the open state;

(3) a latching spring urging the blade toward the closed state.

23. The arrowhead of claim 22 wherein:

a. the actuating member is actuated to move with respect to the body in response to forces acting rearwardly and forwardly on the tip, with such movement pivoting the blade between the open and closed states, b. the blade, once in the open state, is fixed in the open state such that the blade may thereafter only pivot into the closed state by movement of the actuating member in response to forces acting forwardly on the tip.

24. The arrowhead of claim 22 wherein the actuating member is fixed to, and extends rearwardly from, the tip.

25. The arrowhead of claim 22 wherein the actuating member is constantly biased by an opening spring situated between the body and the actuating member.

26. The arrowhead of claim 25 wherein the opening spring and latching spring:

a. are coaxial with, and b. spaced along, the axis of the body.

27. The arrowhead of claim 25 wherein the opening spring and latching spring are concentrically spaced.

28. The arrowhead of claim 25 wherein the latching spring is spaced radially outwardly from the opening spring.

29. The arrowhead of claim 25 wherein the opening spring is at least partially situated within the latching spring.

30. The arrowhead of claim 25 wherein:

a. the opening spring compresses as the latching spring extends, and b. the latching spring compresses as the opening spring extends.

31. The arrowhead of claim 25 wherein the actuating member is fixed to the tip.

32. The arrowhead of claim 25 wherein:

a. the pivot end of the blade includes an actuating ear extending therefrom;

b. the actuating member engages the actuating ear when urging the blade toward the open state.

33. The arrowhead of claim 22 wherein:

a. the arrowhead includes two or more of the blades; and b. when the blades are in the open state, the actuating member rests between the blades, with the blades being urged against the actuating member's circumference.

34. The arrowhead of claim 33 wherein:

a. the pivot end of each blade includes an actuating ear extending therefrom;

b. the actuating member includes a protruding nub wherein:

(1) when the blades are in the open state, the nub rests between the actuating ears of the blades, with the actuating ears being urged against the nub's circumference;

(2) when the blades are in the closed state, the nub does not rest between the actuating ears of the blades.

35. The arrowhead of claim 22 wherein the latching spring is biased between the body and the pivot end of the blade.

36. The arrowhead of claim 22 wherein:

a. the pivot end of the blade includes a camming surface thereon;

b. the latching spring acts on the camming surface to urge the blade toward the closed state;

c. the camming surface is contoured to:

(1) store energy within the latching spring when the blade is in the open state, and (2) relieve energy stored within the latching spring when the blade is in the closed state.

37. The arrowhead of claim 22 wherein the tip:

a. extends rearwardly from a leading edge, and b. includes:

(1) one or more penetrating surfaces sloping outwardly with respect to the axis of the tip as these penetrating surfaces extend rearwardly;

(2) one or more collecting surfaces which are forwardly exposed on the tip, the collecting surfaces being oriented:

i. at least substantially perpendicular to the axis of the tip, and/or ii. concave with respect to a plane perpendicular to the axis of the tip.

38. The arrowhead of claim 22 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

39. The arrowhead of claim 22 wherein the tip, at its region of greatest circumference, lacks any edges which are sufficiently sharp to cut a user's finger when grasped by a user.

40. An arrowhead including:

a. a tip having a rearwardly extending actuating member fixed thereon;

b. a body including:

(1) an interior wherein the actuating member moves, (2) at least one blade having a pivot end pivotally mounted to the body, the blade being pivotable between:

i. an open state wherein the blade is folded outwardly from the body, and ii. a closed state wherein the blade is folded inwardly to rest closer to the body, wherein the blade moves from its closed state to its open state when the actuating member is urged rearwardly into the interior of the body;

c. a latching spring urging the blade toward the closed state.

41. The arrowhead of claim 40 wherein the blade, once in the open state, is fixed in the open state such that the blade may thereafter only pivot into the closed state when the actuating member is urged forwardly in response to forces acting forwardly on the tip.

42. The arrowhead of claim 40 wherein:

a. the pivot end of the blade includes a camming surface thereon;

b. the latching spring acts on the camming surface to urge the blade toward the closed state;

c. the camming surface is contoured to:

(1) store energy within the latching spring when the blade is in the open state, and (2) relieve energy stored within the latching spring when the blade is in the closed state.

43. The arrowhead of claim 40 wherein the actuating member acts on the pivot end of the blade to move the blade from its closed state to its open state when the actuating member is urged rearwardly into the interior of the body.

44. The arrowhead of claim 43 wherein:

a. the pivot end of the blade includes an actuating ear extending therefrom;

b. the actuating member includes a protruding nub wherein:

(1) a face of the nub acts on the actuating ear to move the blade from its closed state to its open state when the actuating member is urged rearwardly into the interior of the body, and (2) when the blade is in the open state, the face of the nub rests off of and adjacent to the actuating ear.

45. The arrowhead of claim 40 wherein:

a. the arrowhead includes two or more of the blades; and b. when the blades are in the open state, the actuating member rests between the blades, with the blades being urged against the actuating member's circumference.

46. The arrowhead of claim 45 wherein:

a. the pivot end of each blade includes an actuating ear extending therefrom;

b. the actuating member includes a protruding nub wherein:

(1) when the blades are in the open state, the nub rests between the actuating ears of the blades, with the actuating ears being urged against the nub's circumference;

(2) when the blades are in the closed state, the nub does not rest between the actuating ears of the blades.

47. The arrowhead of claim 40 wherein the latching spring is situated between the body and the pivot end of the blade.

48. The arrowhead of claim 40 wherein the actuating member is urged rearwardly into the interior of the body by an opening spring situated between the body and the actuating member.

49. The arrowhead of claim 48 wherein the opening spring and latching spring:

a. are coaxial with, and b. spaced along, the axis of the body.

50. The arrowhead of claim 48 wherein the opening spring and latching spring are radially spaced along the axis of the arrowhead.

51. The arrowhead of claim 48 wherein the latching spring at least partially surrounds the opening spring.

52. The arrowhead of claim 48 wherein:

a. the opening spring compresses as the latching spring extends, and b. the latching spring compresses as the opening spring extends.

53. The arrowhead of claim 40 wherein the tip:

a. extends rearwardly from a leading edge, and b. includes:

(1) one or more penetrating surfaces sloping outwardly with respect to the axis of the tip as these penetrating surfaces extend rearwardly;

(2) one or more collecting surfaces which are forwardly exposed on the tip, the collecting surfaces being oriented:

i. at least substantially perpendicular to the axis of the tip, and/or ii. concave with respect to a plane perpendicular to the axis of the tip.

54. The arrowhead of claim 40 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

55. The arrowhead of claim 40 wherein the tip, at its region of greatest circumference, lacks any edges which are sufficiently sharp to cut a user's finger when grasped by a user.

56. An arrowhead including:

a. a tip having an actuating member extending rearwardly therefrom;

b. a body including:

(1) an interior wherein the actuating member is movably received, (2) at least one blade having a pivot end fixed to the body at a pivot, the blade being swingable about the pivot between:

i. an open state wherein the blade is folded outwardly from the body, and ii. a closed state wherein the blade is folded inwardly to rest closer to the body, wherein the actuating member, when urged rearwardly into the interior, urges the blade from its closed state to its open state;

c. an opening spring urging the actuating member rearwardly into the interior.

57. The arrowhead of claim 56 wherein the blade, once in the open state, is fixed in the open state such that the blade may thereafter only pivot into the closed state when the actuating member is urged forwardly in response to forces acting forwardly on the tip.

58. The arrowhead of claim 56 further including a latching spring urging the blade toward the closed state.

59. The arrowhead of claim 58 wherein:

a. the pivot end of the blade includes a camming surface thereon;

b. the latching spring acts on the camming surface to urge the blade toward the closed state;

c. the camming surface is contoured to:

(1) store energy within the latching spring when the blade is in the open state, and (2) relieve energy stored within the latching spring when the blade is in the closed state.

60. The arrowhead of claim 58 wherein the opening spring and latching spring:

a. are coaxial with, and b. spaced along, the axis of the body.

61. The arrowhead of claim 58 wherein the latching spring is biased between the body and the pivot end.

62. The arrowhead of claim 58 wherein the latching spring and the opening spring have different radial spacings with respect to the axis of the arrowhead.

63. The arrowhead of claim 58 wherein the latching spring at least partially surrounds the opening spring.

64. The arrowhead of claim 58 wherein:

a. the opening spring compresses as the latching spring extends, and b. the latching spring compresses as the opening spring extends.

65. The arrowhead of claim 56 wherein the actuating member acts on the pivot end of the blade to urge the blade from its closed state to its open state when the actuating member is urged rearwardly into the interior of the body.

66. The arrowhead of claim 65 wherein:

a. the pivot end of the blade includes an actuating ear extending therefrom;

b. the actuating member includes a protruding nub wherein:

(1) a face of the nub presses against the actuating ear to urge the blade from its closed state to its open state when the actuating member is urged rearwardly into the interior of the body, and (2) when the blade is in the open state, the face of the nub rests off of the actuating ear.

67. The arrowhead of claim 56 wherein:

a. the arrowhead includes two or more of the blades; and b. when the blades are in the open state, the actuating member rests between the blades, with the blades being urged against the actuating member's circumference.

68. The arrowhead of claim 67 wherein:

a. the pivot end of each blade includes an actuating ear extending therefrom;

b. the actuating member includes a protruding nub wherein:

(1) when the blades are in the open state, the nub rests between the actuating ears of the blades, with the actuating ears being urged against the nub's circumference;

(2) when the blades are in the closed state, the nub does not rest between the actuating ears of the blades.

69. The arrowhead of claim 56 wherein the tip:

a. extends rearwardly from a leading edge, and b. includes:

(1) one or more penetrating surfaces sloping outwardly with respect to the axis of the tip as these penetrating surfaces extend rearwardly;

(2) one or more collecting surfaces which are forwardly exposed on the tip, the collecting surfaces being oriented:

i. at least substantially perpendicular to the axis of the tip, and/or ii. concave with respect to a plane perpendicular to the axis of the tip.

70. The arrowhead of claim 56 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

71. The arrowhead of claim 56 wherein the tip, at its region of greatest circumference, lacks any edges which are sufficiently sharp to cut a user's finger when grasped by a user.

72. An arrowhead including:

a. a tip having an actuating member mounted in fixed relation rearwardly from the tip;

b. a body including:

(1) an interior wherein the actuating member travels, (2) at least one blade pivotally swingable between:

i. an open state wherein the blade is folded outwardly from the body, and ii. a closed state wherein the blade is folded inwardly to rest closer to the body, wherein the blade moves from its closed state to its open state when the actuating member is urged rearwardly into the interior;

c. a first spring urging the actuating member rearwardly into the interior;

d. a second spring:

(1) separate from the first spring, and (2) biasing the blade with respect to the body.

73. The arrowhead of claim 72 wherein the blade, once in the open state, is fixed in the open state such that the blade may thereafter only pivot into the closed state when the actuating member is urged forwardly in response to forces acting forwardly on the tip.

74. The arrowhead of claim 72 wherein the blade has a pivot end pivotably affixed to the body at a pivot.

75. The arrowhead of claim 74 wherein the second spring is biased between the body and the pivot end.

76. The arrowhead of claim 74 wherein the actuating member is constantly biased against the pivot end.

77. The arrowhead of claim 74 wherein:

a. the pivot end of the blade includes an actuating ear extending therefrom, and b. the actuating member acts on the actuating ear to move the blade from its closed state to its open state.

78. The arrowhead of claim 72 wherein:

a. the blade includes a camming surface thereon upon which the second spring acts;

b. the camming surface is contoured to:

(1) store energy within the second spring when the blade is in the open state, and (2) relieve energy stored within the second spring when the blade is in the closed state.

79. The arrowhead of claim 72 wherein:

a. the arrowhead includes two or more of the blades; and b. when the blades are:

(1) in the open state, the actuating member rests between the blades, with the blades being urged about the actuating member's circumference, and (2) in the closed state, the blades are not urged about the actuating member's circumference.

80. The arrowhead of claim 72 wherein the second spring biases the blade toward the closed state.

81. The arrowhead of claim 72 wherein the first spring is at least partially situated within the second spring.

82. The arrowhead of claim 72 wherein the first and second spring:

a. are coaxial with, and b. spaced along, the axis of the body.

83. The arrowhead of claim 72 wherein:

a. the first spring compresses as the second spring extends, and b. the second spring compresses as the first spring extends.

84. The arrowhead of claim 72 wherein the tip:

a. extends rearwardly from a leading edge, and b. includes:

(1) one or more penetrating surfaces sloping outwardly with respect to the axis of the tip as these penetrating surfaces extend rearwardly;

(2) one or more collecting surfaces which are forwardly exposed on the tip, the collecting surfaces being oriented:

i. at least substantially perpendicular to the axis of the tip, and/or ii. concave with respect to a plane perpendicular to the axis of the tip.

85. The arrowhead of claim 72 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

86. The arrowhead of claim 72 wherein the tip, at its region of greatest circumference, lacks any edges which are sufficiently sharp to cut a user's finger when grasped by a user.

87. An arrowhead including:

a. a tip;

b. a body extending rearwardly from the tip, the body including at least one blade pivotally swingable between:

(1) an open state wherein the blade is folded outwardly from the body, and (2) a closed state wherein the blade is folded inwardly to rest closer to the body, c. a first spring urging the blade toward the open state;

d. a second spring:

(1) separate from the first spring, and (2) urging the blade toward the closed state.

88. The arrowhead of claim 87 wherein the blade:

a. is urged into the open state by the first spring when the tip is subjected to rearward force;

b. is urged into the closed state by the second spring when the tip is subjected to forward force; and c. the blade, once in the open state, is fixed in the open state such that the blade may thereafter only pivot into the closed state when the tip is subjected to rearward force.

89. The arrowhead of claim 87 further including an actuating member which is:

a. translatably movable with respect to the body, and b. constantly biased by the first spring to urge the blade toward the open state.

90. The arrowhead of claim 89 wherein:

a. the arrowhead includes two or more of the blades; and b. when the blades are:

(1) in the open state, the actuating member rests between the blades, with the blades being urged about the actuating member's circumference, and (2) in the closed state, the blades are not urged about the actuating member's circumference.

91. The arrowhead of claim 87:

a. wherein the blade includes a pivot end rotatably linked to the body at a pivot, and b. further including an actuating member movable within the body, wherein the blade moves from its closed state to its open state when the actuating member is urged toward the pivot.

92. The arrowhead of claim 91 wherein the actuating member is fixed to and extends rearwardly from the tip.

93. The arrowhead of claim 91 wherein the actuating member acts on the pivot end of the blade to move the blade from its closed state to its open state.

94. The arrowhead of claim 93 wherein:

a. the pivot end of the blade includes an actuating ear extending therefrom;

b. the actuating member includes a protruding nub wherein:

(1) when the blade is in the closed state, a face of the nub acts on the actuating ear to move the blade from its closed state to its open state, and (2) when the blade is in the open state, the face of the nub rests off of and adjacent to the actuating ear.

95. The arrowhead of claim 94 wherein:

a. the arrowhead includes two or more of the blades; and b. when the blades are:

(1) in the open state, the nub rests between the blades, with the blades being urged about the nub's circumference, and (2) in the closed state, the blades are not urged about the nub's circumference.

96. The arrowhead of claim 87 wherein:

a. the blade includes a camming surface thereon upon which the second spring acts;

b. the camming surface is contoured to:

(1) store energy within the second spring when the blade is in the open state, and (2) relieve energy stored within the second spring when the blade is in the closed state.

97. The arrowhead of claim 87 wherein the first spring and second springs are radially spaced with respect to the axis of the arrowhead.

98. The arrowhead of claim 87 wherein the first and second spring:

a. are coaxial with, and b. spaced along, the axis of the body.

99. The arrowhead of claim 87 wherein:

a. the first spring compresses as the second spring extends, and b. the second spring compresses as the first spring extends.

100. The arrowhead of claim 87 wherein the tip:

a. extends rearwardly from a leading edge, and b. includes:

(1) one or more penetrating surfaces sloping outwardly with respect to the axis of the tip as these penetrating surfaces extend rearwardly;

(2) one or more collecting surfaces which are forwardly exposed on the tip, the collecting surfaces being oriented:

i. at least substantially perpendicular to the axis of the tip, and/or ii. concave with respect to a plane perpendicular to the axis of the tip.

101. The arrowhead of claim 87 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

102. The arrowhead of claim 87 wherein the tip, at its region of greatest circumference, lacks any edges which are sufficiently sharp to cut a user's finger when grasped by a user.

103. An arrowhead including:

a. a tip extending rearwardly from a leading edge, the tip including:

(1) one or more penetrating surfaces sloping outwardly with respect to the axis of the tip as these penetrating surfaces extend rearwardly;

(2) one or more collecting surfaces, the collecting surfaces being forwardly exposed and being oriented:

i. at least substantially perpendicular to the axis of the tip, and/or ii. concave with respect to a plane perpendicular to the axis of the tip;

b. an actuating member which moves in response to forces acting rearwardly and forwardly on the tip;

c. a body including:

(1) an interior wherein the actuating member is received, (2) at least one blade having a pivot end about which the blade pivots with respect to the body, the blade being pivotable between:

i. an open state wherein the blade is folded outwardly from the body, and ii. a closed state wherein the blade is folded inwardly to rest closer to the body, wherein actuating member moves the blade from its closed state to its open state when the tip is subjected to rearward force.

104. The arrowhead of claim 103 wherein the blade, once in the open state, is fixed in the open state such that the blade may thereafter only pivot into the closed state when the tip is subjected to forward force.

105. The arrowhead of claim 103 wherein:

a. the actuating member is fixed to, and extends rearwardly from, the tip; and b. the blade moves from its closed state to its open state when the actuating member is urged rearwardly into the interior.

106. The arrowhead of claim 103 wherein the blade includes a pivot end rotatably linked to the body at a pivot.

107. The arrowhead of claim 106 wherein:

a. the pivot end of the blade includes an actuating ear extending therefrom;

b. the actuating member includes a protruding nub, wherein the nub acts on the actuating ear to move the blade from its closed state to its open state.

108. The arrowhead of claim 103 wherein:

a. the arrowhead includes two or more of the blades;

b. the pivot end of each blade includes an actuating ear extending therefrom;

c. the actuating member includes a protruding nub wherein:

(1) when the blades are in the open state, the nub rests between the actuating ears of the blades, with the actuating ears being urged against the nub's circumference;

(2) when the blades are in the closed state, the nub does not rest between the actuating ears of the blades.

109. The arrowhead of claim 103 wherein:

a. the arrowhead includes two or more of the blades; and b. when the blades are in the:

(1) open state, the actuating member rests between the blades, with the blades being urged against the actuating member's circumference;

(2) closed state, the blades are urged against a surface on the actuating member situated off of the actuating member's circumference.

110. The arrowhead of claim 103 further including an opening spring which biases the actuating member rearwardly.

111. The arrowhead of claim 103 further including a latching spring which biases the blade toward the closed state.

112. The arrowhead of claim 111 further including an opening spring urging the blade toward the open state.

113. The arrowhead of claim 103 wherein:

a. the pivot end of the blade includes a camming surface thereon;

b. the arrowhead further includes a latching spring which acts on the camming surface;

c. the camming surface is contoured to:

(1) store energy within the latching spring when the blade is in the open state, and (2) relieve energy stored within the latching spring when the blade is in the closed state.

114. The arrowhead of claim 103 wherein the tip includes continuous surfaces bounded by edges, and wherein at least one of the continuous surfaces:

a. extends both rearwardly and circumferentially, b. is aligned at least substantially parallel to the axis extending through the tip and body, and c. has an area greater than or equal to one-third of the largest continuous surface included on the tip.

115. The arrowhead of claim 103 wherein the tip, at its region of greatest circumference, lacks any edges which are sufficiently sharp to cut a user's finger when grasped by a user.

* * * * *